US012751549B2

(12) United States Patent
Leng

(10) Patent No.: US 12,751,549 B2
(45) Date of Patent: Oct. 6, 2026

(54) SEAT BOARD OF FOLDABLE CHAIR AND BOTTOM FRAME THEREOF

(71) Applicant: Luhao Leng, Xiamen City (CN)

(72) Inventor: Luhao Leng, Xiamen City (CN)

( * ) Notice: Subject to any disclaimer, the term of this patent is extended or adjusted under 35 U.S.C. 154(b) by 85 days.

(21) Appl. No.: 18/897,064

(22) Filed: Sep. 26, 2024

(65) Prior Publication Data

US 2025/0017380 A1 Jan. 16, 2025

Related U.S. Application Data

(63) Continuation of application No. PCT/CN2023/089211, filed on Apr. 19, 2023.

(30) Foreign Application Priority Data

Apr. 21, 2022 (CN) ..... 202220932384.0
Apr. 21, 2022 (CN) ..... 202220932706.1

(51) Int. Cl.
*A47C 7/16* (2006.01)
*A47C 4/24* (2006.01)

(52) U.S. Cl.
CPC . *A47C 7/16* (2013.01); *A47C 4/24* (2013.01)

(58) Field of Classification Search
CPC ..... A47C 7/16; A47C 4/24
USPC ..... 297/452.1
See application file for complete search history.

(56) References Cited

U.S. PATENT DOCUMENTS 8,882,188 B2 11/2014 Jin
11,140,989 B2 * 10/2021 Kumazawa ..... A47C 7/027
11,602,223 B2 * 3/2023 Deevers ..... A47C 7/029
2003/0034676 A1 * 2/2003 Wen ..... A47C 4/24 297/58
2003/0127887 A1 7/2003 Laws et al.
(Continued)

FOREIGN PATENT DOCUMENTS

CN 201208075 Y 3/2009
CN 203416982 U 2/2014
(Continued)

OTHER PUBLICATIONS

Corresponding International Patent Application No. PCT/CN2023/089211, International Search Report, date mailed Aug. 10, 2023, 8 pages.
(Continued)

*Primary Examiner* — Jose V Chen
(74) *Attorney, Agent, or Firm* — Cooper Legal Group, LLC

(57) ABSTRACT

A seat board of a foldable chair includes a panel and a bottom frame. A top portion of the bottom frame is bent to form an annular inner blocking edge and an annular outer pressing edge, and an annular installation groove is formed between the annular inner blocking edge and the annular outer pressing edge. The panel form an annular folded-downward edge, and the annular folded-downward edge is inserted into the annular installation groove. The annular inner blocking edge cooperates with the annular outer pressing edge to clamp and secure the annular folded-downward edge. Two elongated sliding slots are symmetrically located on outer side edges of a right side and a left side of the bottom frame, and the two T-shaped rivets are slidably connected to the seat board and chair legs.

14 Claims, 8 Drawing Sheets

(56) References Cited

U.S. PATENT DOCUMENTS

| | | | | |
|---|---|---|---|---|
| 2005/0017554 | A1* | 1/2005 | Mizelle | A47C 4/24 297/218.3 |
| 2009/0261628 | A1 | 10/2009 | Leng | |
| 2015/0201759 | A1* | 7/2015 | Winters | A47C 4/04 297/48 |
| 2017/0164746 | A1* | 6/2017 | Phillips | A47C 7/029 |
| 2019/0290003 | A1* | 9/2019 | Leng | B32B 3/08 |
| 2020/0046122 | A1* | 2/2020 | Ogg | A47C 4/04 |
| 2021/0007493 | A1* | 1/2021 | Piretti | A47C 4/14 |
| 2022/0354256 | A1* | 11/2022 | Leng | A47C 7/16 |

FOREIGN PATENT DOCUMENTS

| | | | |
|---|---|---|---|
| CN | 112535371 | A | 3/2021 |
| CN | 217852034 | U | 11/2022 |
| CN | 217852047 | U | 11/2022 |
| ES | 133500 | U | 3/1968 |
| ES | 247973 | U | 4/1980 |
| JP | 3178288 | U | 9/2012 |

OTHER PUBLICATIONS

Corresponding International Patent Application No. PCT/CN2023/089211, Written Opinion, date mailed Aug. 10, 2023, 7 pages.
EP Office Action cited in EP23791272.0, mailed Jun. 13, 2025, 6 pages.
EP Search Report cited in EP23791272.0, mailed Jun. 3, 2025, 4 pages.
AU Office Action cited in AU2023258201, mailed Feb. 4, 2026, 4 pages.
AU Office Action cited in AU2023258201, mailed Oct. 30, 2025, 3 pages.

* cited by examiner

SEAT BOARD OF FOLDABLE CHAIR AND BOTTOM FRAME THEREOF

RELATED APPLICATIONS

This application is a continuation application of International patent application PCT/CN2023/089211, filed on Apr. 19, 2023, which claims priority to Chinese patent application 202220932384.0, filed on Apr. 21, 2022 and Chinese patent application 202220932706.1, filed on Apr. 21, 2022. International patent application PCT/CN2023/089211, Chinese patent application 202220932384.0, and Chinese patent application 202220932706.1 are incorporated herein by reference.

FIELD OF THE DISCLOSURE

The present disclosure relates to a foldable chair, and in particular relates to a seat board and a bottom frame thereof.

BACKGROUND OF THE DISCLOSURE

A bottom frame of a seat board of a foldable chair is used to support a panel and is connected to a front leg and a rear leg. The front leg and the rear leg intersect in an X-shaped intersection arrangement. A rotation point of the front leg and the rear leg, a rotation point of the front leg and the bottom frame, and a rotation point of the rear leg and the bottom frame form a triangle. As the foldable chair needs to be foldable, the triangle formed by the three rotation points continuously varies during a folding process, making an avoidance mechanism essential for the foldable chair. An arrangement of the avoidance mechanism generally comprises two types: in one type, the rear leg or the front leg is retractable, and in the other type, the rotation point of the front leg and the rear leg or the rotation point of the front leg and the bottom frame is slidable. These folding principles are familiar to people of skill in the art. A common structure for making the rotation point of the front leg and the rear leg or the rotation point of the front leg and the bottom frame to be slidable is to dispose an elongated metal sheet on the seat board, and the elongated metal sheet has an elongated hole. During assembly, one end of a pivot shaft is connected to the front leg or the rear leg, and the other end of the pivot shaft is inserted into the elongated hole and is positioned by cooperating with a position-limiting member like a bolt to prevent the pivot shaft from disengaging. Therefore, this structure requires additional metal parts, resulting in the structure being inconvenient to assemble.

A connection between a plastic panel and a metal frame directly affects strength and durability of the seat board. Traditional assembly methods use glue to cooperate with rivets for fixation. However, applying glue around the plastic panel is labor-intensive and material-intensive, and using glue is not environmentally friendly. Additionally, only a few positions can be arranged using a method for fixation using the rivets, resulting in uneven stress applied around the plastic panel. Of course, a metal bottom plate can be used instead of the metal frame. In this method, the plastic panel is placed on the metal bottom plate and fixed together using screws underneath. In this method, the metal bottom plate is heavy and material-intensive, a structure is complex, and the overall structure is unwieldy and material-consuming.

BRIEF SUMMARY OF THE DISCLOSURE

The present disclosure provides a seat board of a foldable chair and a bottom frame thereof, and an assembly is simple.

The technical solutions adopted by the present disclosure to solve the technical problem thereof are described as follows.

A seat board of a foldable chair, the seat board of the foldable chair comprises a panel and a bottom frame, the bottom frame is formed by bending a metal sheet material, has a rectangular shape, and has smooth transitions on four corners, a section of the bottom frame comprises a top portion, side portions, and a bottom portion, the top portion of the bottom frame is bent to form an annular inner blocking edge and an annular outer pressing edge, an annular installation groove having an upper opening is formed between the annular inner blocking edge and the annular outer pressing edge, four sides of the panel form an annular folded-downward edge folded downward, the annular folded-downward edge is inserted into the annular installation groove from top to bottom, the annular inner blocking edge cooperates with the annular outer pressing edge to clamp and secure the annular folded-downward edge, two elongated sliding slots extending in a front and rear direction and configured for two T-shaped rivets to slide are symmetrically located on an outer side edge of a left side of the bottom frame and an outer side edge of a right side of the bottom frame, and the two T-shaped rivets are slidably connected to the seat board and chair legs of the foldable chair.

The bottom frame comprises the two elongated sliding slots, and first ends of the two elongated sliding slots comprise enlarged holes. Two T-shaped rivets can be directly inserted into the two elongated sliding slots through the enlarged holes, and two rivets for pivotally connecting to chair legs can then be directly enclosed on the enlarged holes, allowing the two T-shaped rivets and the two rivets for connecting the chair legs to be respectively connected to two front legs and two rear legs on side edges of the foldable chair. The structure is quite simple and has an advantage of easier assembly.

In a preferred embodiment, a section of the bottom frame is a closed-ring hollow tube structure.

In a preferred embodiment, an inner side edge and an outer side edge of the section of the bottom frame are vertical edges.

In a preferred embodiment, the section of the bottom frame is a non-closed ring with a side facing inward being an open structure.

In a preferred embodiment, an outer side edge of the section of the bottom frame is a vertical edge, and a bottom edge of the section of the bottom frame is a horizontal straight edge.

In a preferred embodiment, an inner end of the bottom edge of the section of the bottom frame is bent upward and toward an inner side of the bottom frame to form a C-shaped extension segment, the inner end of the bottom edge of the section of the bottom frame is bent to form an inclined extension segment with a distal end of the inclined extension segment abutting the bottom edge of the section of the bottom frame, or the inner end of the bottom edge of the section of the bottom frame is bent to form a horizontal extension segment overlapping and abutting the bottom edge of the section of the bottom frame. The extension segment enhances a strength of the bottom frame.

In a preferred embodiment, bent steps are formed on both a top position and a bottom position of an outer side edge of a section of the bottom frame. The bent steps can easily cooperate with a C-shaped sheath.

During assembly, after the annular folded-downward edge is inserted into the annular installation groove, the annular outer pressing edge is deformed or both of the annular inner blocking edge and the annular outer pressing edge are deformed together to tightly clamp and secure the annular folded-downward edge, and the assembly is very convenient. Additionally, the annular folded-downward edge around the panel is tightly clamped and secured by cooperation of the annular inner blocking edge and the annular outer pressing edge, ensuring a very strong connection and secure connection between the panel and the bottom frame, and stress around the panel is evenly applied. The seat board with this structure uses a vacuum-formed plastic panel to match with a metal frame, offering the advantages of being lightweight and material-saving while ensuring the panel is securely and stably fixed.

The seat board comprises the panel and the bottom frame, and the panel is connected to the bottom frame. The bottom frame also brings the benefits of a simple structure and easy assembly. Moreover, the annular folded-downward edge around the panel is inserted into the annular installation groove, providing a very secure fixation and stress around the panel being evenly applied.

In a preferred embodiment, the top portion of the bottom frame is bent to form the annular inner blocking edge and the annular outer pressing edge, and the annular installation groove is formed between the annular inner blocking edge and the annular outer pressing edge. The annular inner blocking edge cooperates with the annular outer pressing edge to tightly clamp and secure the annular folded-downward edge.

In a preferred embodiment, the annular inner blocking edge is a vertical edge. The annular folded-downward edge abuts the annular inner blocking edge after being inserted into the annular installation groove. The annular outer pressing edge is bent inward to be deformed to tightly clamp and secure the annular folded-downward edge during assembly.

BRIEF DESCRIPTION OF THE DRAWINGS

The present disclosure will be further described below in conjunction with the accompanying drawings and embodiments.

DETAILED DESCRIPTION OF THE EMBODIMENTS

The technical solutions in the embodiments of the present disclosure will be clearly and completely described below with reference to the accompanying drawings in the embodiments of the present disclosure. It is obvious that the described embodiments are preferred embodiments of the present disclosure and should not be understood as exclusive of other embodiments. All other embodiments fall within the protective scope of the present disclosure provided that they are obtained by people of ordinary skill in the art based on the embodiments of the present disclosure without making creative efforts.

Figure 1:
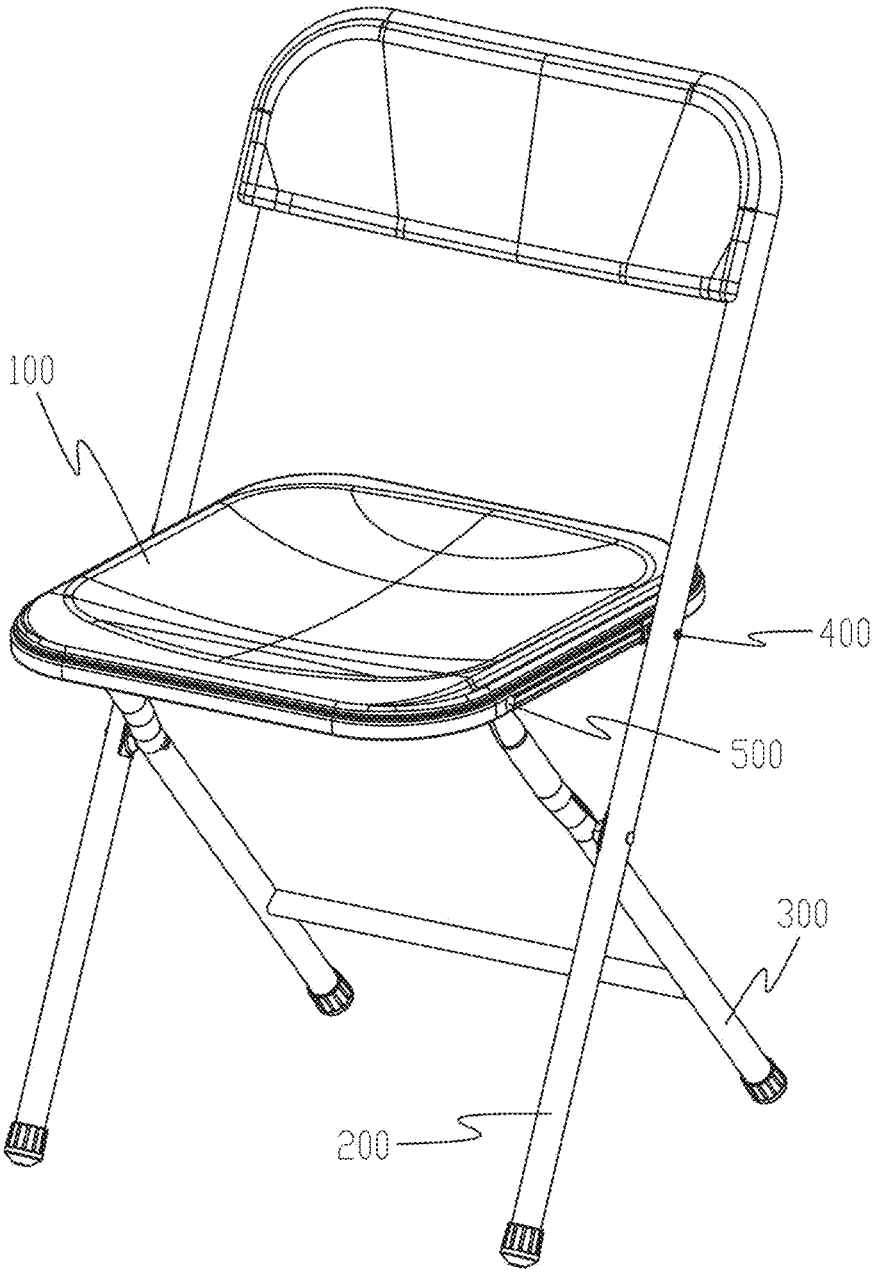
FIG. 1 illustrates a perspective view of a foldable chair using a seat board of the present disclosure.
Figure 2:
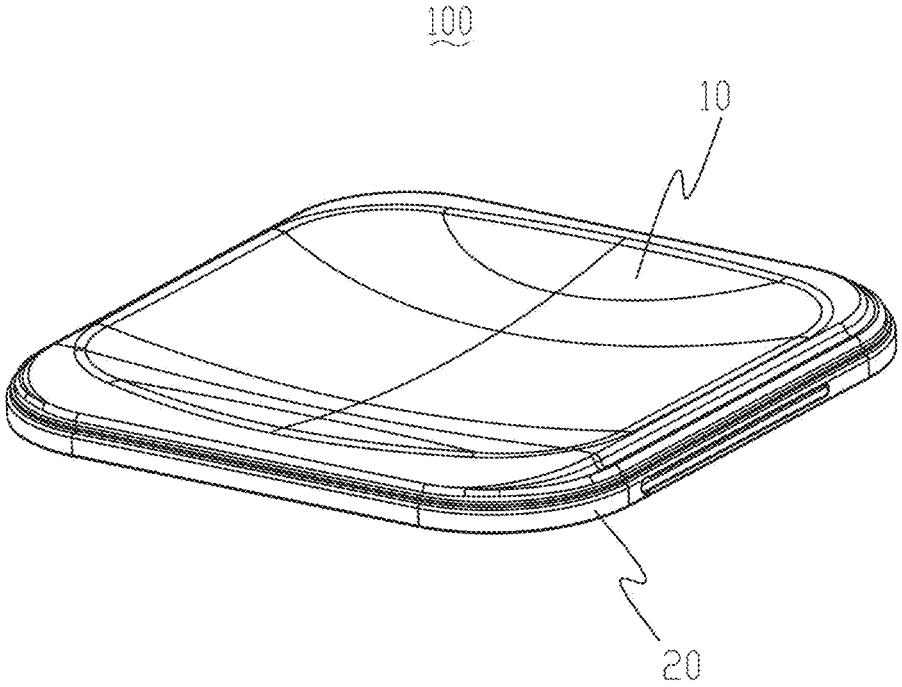
FIG. 2 illustrates a diagrammatic view of a body of the seat board of the present disclosure.
Figure 3:
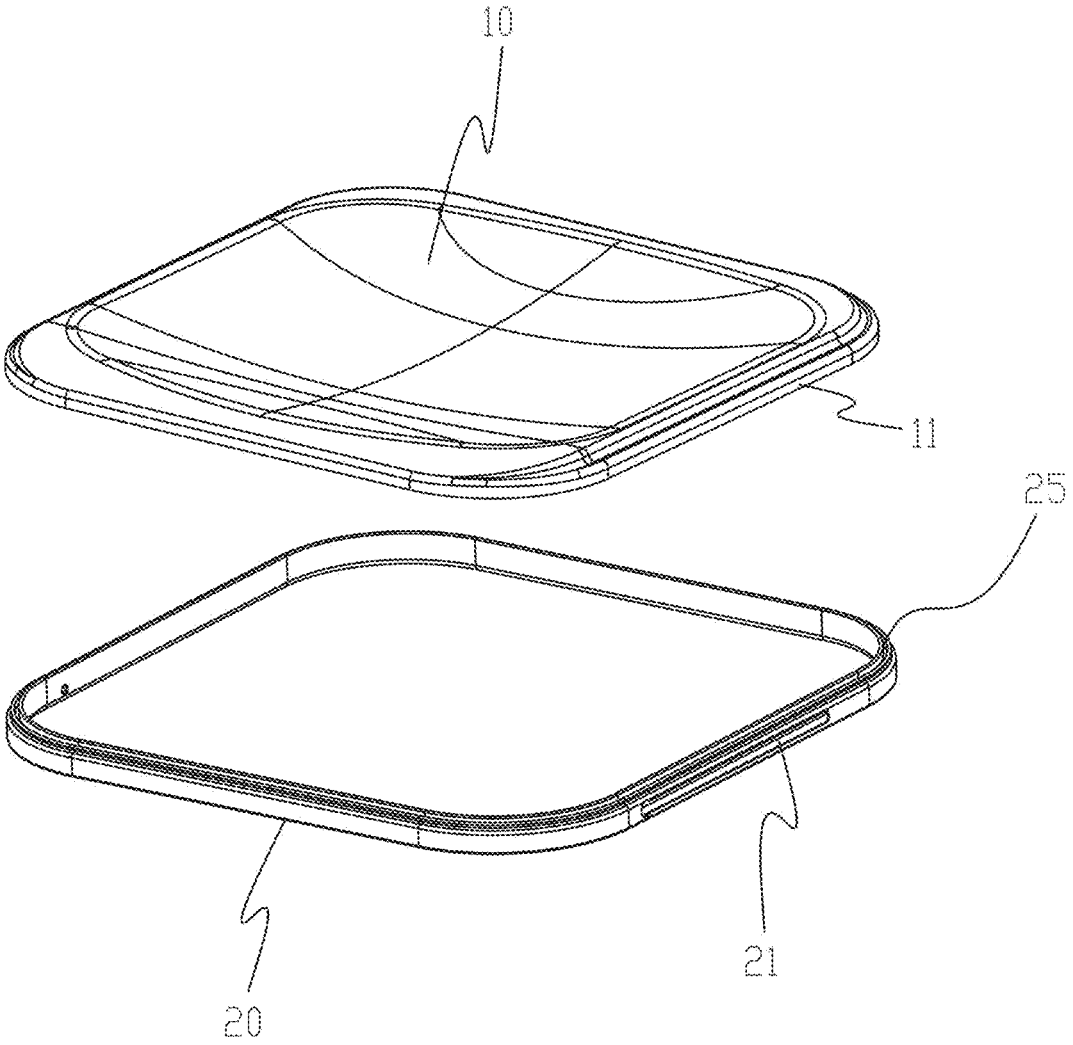
FIG. 3 illustrates an exploded perspective view of the seat board shown in FIG. 2 before assembly.
Figure 4:
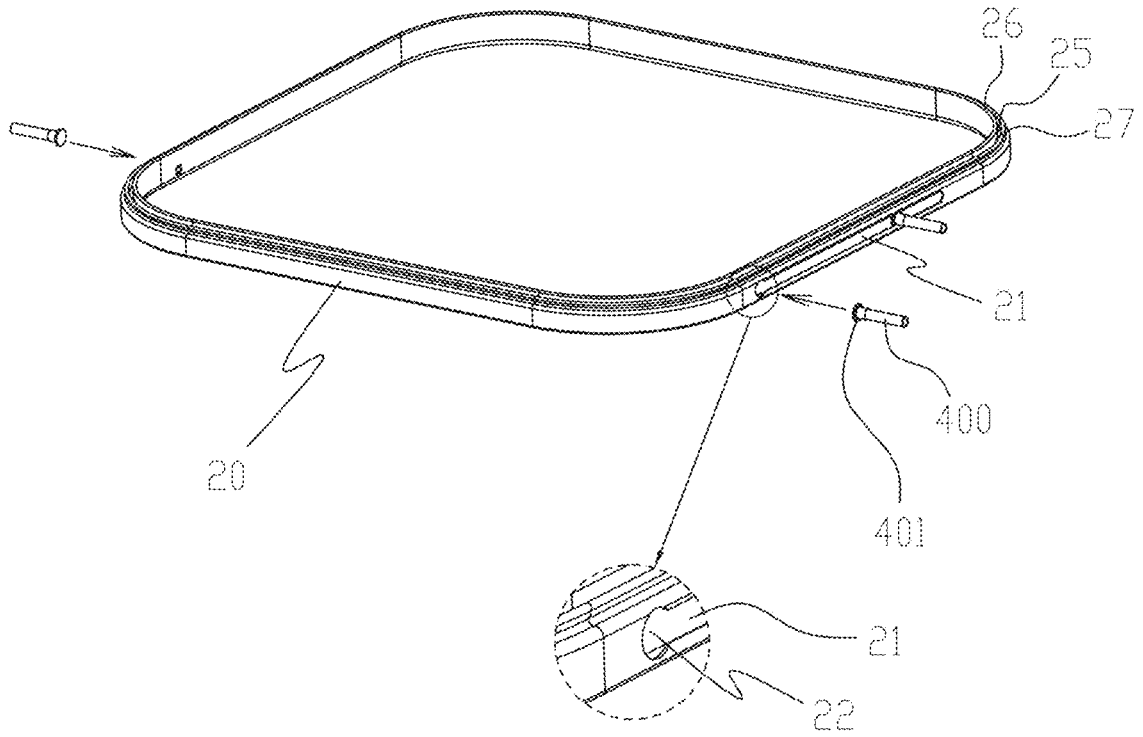
FIG. 4 illustrates a perspective view of a bottom frame shown in FIG. 2.

In the claims, the specification, and the accompany drawings of the present disclosure, unless otherwise explicitly specified, with respect to oriental terms, for example, terms of "vertical", "top", "bottom", "inner", "outer", "upper", "lower", "front", "rear", "left", "right", and the like are used to indicate orientation or positional relationships based on FIG. 1. The orientation or the positional relationships are described in view of a viewpoint of the reader, so that the technical solution of the present disclosure is easily understood to easily describe the present disclosure and simplify the description, rather than indicating or implying that the referenced device or element should have a specific orientation or be constructed and operated in a specified orientation and should not be understood as a limitation of a specific protective scope of the present disclosure.

In the claims, the specification, and the accompanying drawings of the present disclosure, unless otherwise explicitly specified, the terms "fixedly connected" and "fixed connection" should develop broad understanding. That is, there is no connection method of displacement relationship or relative rotational movement relationship between the two components. In other words, the terms "fixedly connected" and "fixed connection" include non-detachable fixed connections, detachable fixed connections, integrated connections, and fixed connections through other devices or elements.

Embodiment

Referring to FIGS. 1-6, a seat board 100 can be assembled together with two front legs 200 and two rear legs 300 to form a foldable chair. The seat board 100 comprises a panel 10 and a bottom frame 20. The panel 10 is connected to the bottom frame 20, and the bottom frame 20 is connected to the two front legs 200 and the two rear legs 300. The bottom frame 20 is a metal member, has a rectangular shape, and has smooth transitions on four corners. An outer side edge of a left side and an outer side edge of a right side of the bottom frame 20 are symmetrically disposed with two elongated sliding slots 21 extending in a front and rear direction and configured for two T-shaped rivets 400 to slide. First ends of the two elongated sliding slots 21 comprise enlarged holes 22 into which caps 401 of the two T-shaped rivets 400 are inserted from outside. Widths of the caps 401 of the two T-shaped rivets 400 are greater than widths of slot openings of the two elongated sliding slots 21 and are smaller than widths of the enlarged holes 22. After the two T-shaped rivets 400 are inserted into the two elongated sliding slots 21, two rivets 500 for pivotally connecting to chair legs (e.g., the two rear legs 300) are installed at positions of the enlarged holes 22. Therefore, in this embodiment, it can be seen that the two front legs 200 are connected to the bottom frame 20 through the two T-shaped rivets 400 and the two rear legs 300 are connected to the bottom frame 20 through the rivets 500. During a folding process, the two T-shaped rivets 400 can slide in the two elongated sliding slots 21 for avoidance.

When the seat board 100 is assembled, the seat board 100 can be respectively connected to the two front legs 200 and the two rear legs 300 through the two T-shaped rivets 400 and the two rivets 500, and an assembly is very simple.

Preferably, a section of the bottom frame 20 is a closed-ring hollow tube structure. In this embodiment, inner and outer side edges of the section of the bottom frame 20 are vertical edges.

Figure 9:
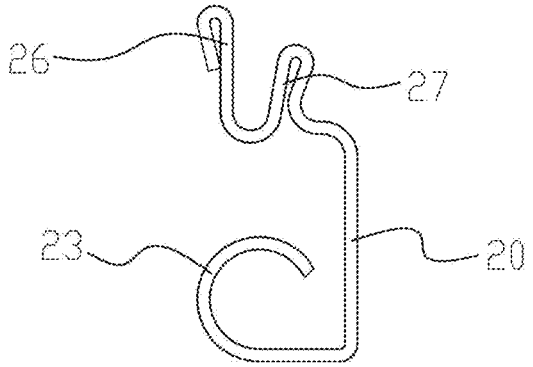
FIG. 9 illustrates a diagrammatic view of a third structural alternative of the bottom frame of the seat board shown in FIG. 2.
Figure 10:
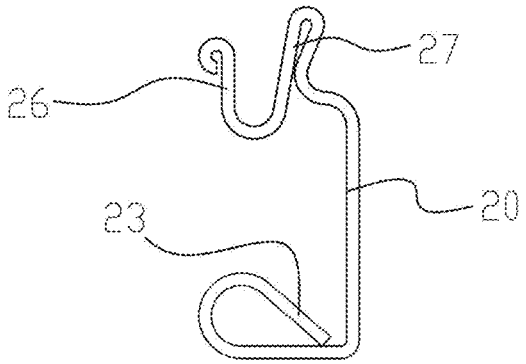
FIG. 10 illustrates a diagrammatic view of a fourth structural alternative of the bottom frame of the seat board shown in FIG. 2.
Figure 11:
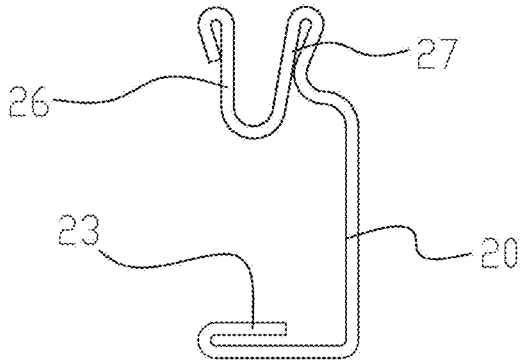
FIG. 11 illustrates a diagrammatic view of a fifth structural alternative of the bottom frame of the seat board shown in FIG. 2.

Certainly, the section of the bottom frame 20 can also be a non-closed ring structure. As shown in FIGS. 9-11, a side of the bottom frame 20 facing inward is an open structure. More preferably, the outer side edge of the section of the bottom frame 20 is a vertical edge, and a bottom edge of the section of the bottom frame 20 is a horizontal straight edge. In FIG. 9, an inner end of the bottom edge of the section of the bottom frame 20 is bent upward and toward the inner side of the bottom frame 20 to form a C-shaped extension segment 23. In FIG. 10, the inner end of the bottom edge of the section of the bottom frame 20 is bent upward and toward the inner side of the bottom frame 20 to form an inclined extension segment 23, and a distal end of the inclined extension segment 23 abuts the bottom edge of the section of the bottom frame 20. In FIG. 11, the inner end of the bottom edge of the section of the bottom frame 20 is bent upward and toward the inner side of the bottom frame 20 to form a horizontal extension segment 23 that overlaps and abuts the bottom edge of the section of the bottom frame 20.

Preferably, bent steps 24 are formed on both a top position and a bottom position of the outer side edge of the section of the bottom frame 20.

A structure of the panel 10 is also shown with reference to FIGS. 1-6. In this embodiment, the panel 10 is a vacuum-formed plastic panel. The panel 10 has a rectangular shape and has smooth transitions on four corners, and four sides of the panel 10 form an annular folded-downward edge 11 folded downward. A top surface of the bottom frame 20 comprises an annular installation groove 25 into which the annular folded-downward edge 11 is inserted from top to bottom.

A top portion of the bottom frame 20 is bent to form an annular inner blocking edge 26 and an annular outer pressing edge 27, and the annular installation groove 25 is formed between the annular inner blocking edge 26 and the annular outer pressing edge 27. The annular inner blocking edge 26 cooperates with the annular outer pressing edge 27 to tightly clamp and secure the annular folded-downward edge 11. More preferably, the annular inner blocking edge 26 is a vertical edge, the annular folded-downward edge 11 abuts the annular inner blocking edge 26 after being inserted into the annular installation groove 25, and the annular outer pressing edge 27 is bent inward to be deformed to tightly clamp and secure the annular folded-downward edge 11 during assembly. During assembly, the annular folded-downward edge 11 is inserted into the annular installation groove 25 from top to bottom, and then the annular inner blocking edge 26 is bent, the annular outer pressing edge 27 is bent, or the annular inner blocking edge 26 and the annular outer pressing edge 27 are bent inward together, finally allowing the annular inner blocking edge 26 to cooperate with the annular outer pressing edge 27 to tightly clamp and secure the annular folded-downward edge 11. That is, the annular folded-downward edge 11 can be freely inserted into the annular installation groove 25 before being secured, and either the annular inner blocking edge 26 or the annular outer pressing edge 27 is deformed or both the annular inner blocking edge 26 and the annular outer pressing edge 27 are deformed together to secure the annular folded-downward edge 11 by applying an external force. Therefore, after the seat board 100 is assembled, the annular inner blocking edge 26 cooperates with the annular outer pressing edge 27 to tightly clamp and secure the annular folded-downward edge 11.

Preferably, the top of the bottom frame 20 is continuously bent to form the annular inner blocking edge 26 and the annular outer pressing edge 27, and a bottom of the annular installation groove 25 has a smooth arc-shaped transition. It can be understood that the bottom frame 20 can be formed by rolling and bending a metal sheet material.

Figure 5:
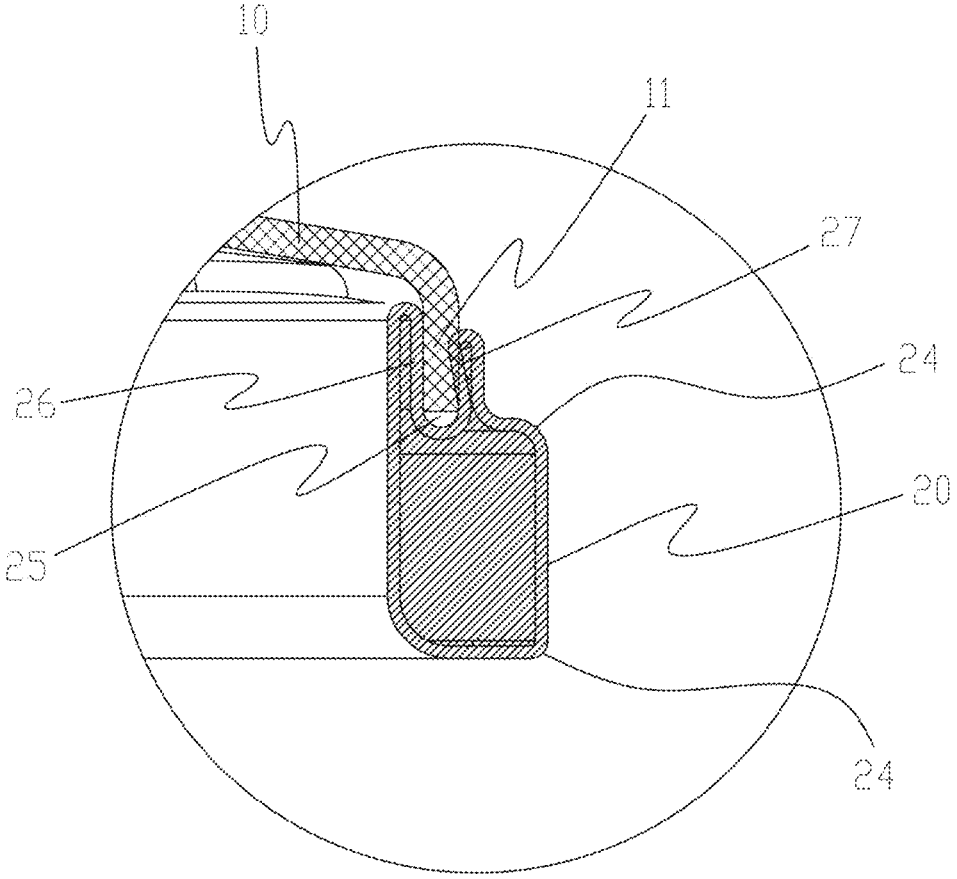
FIG. 5 illustrates a partial sectional view of the seat board shown in FIG. 2.
Figure 6:
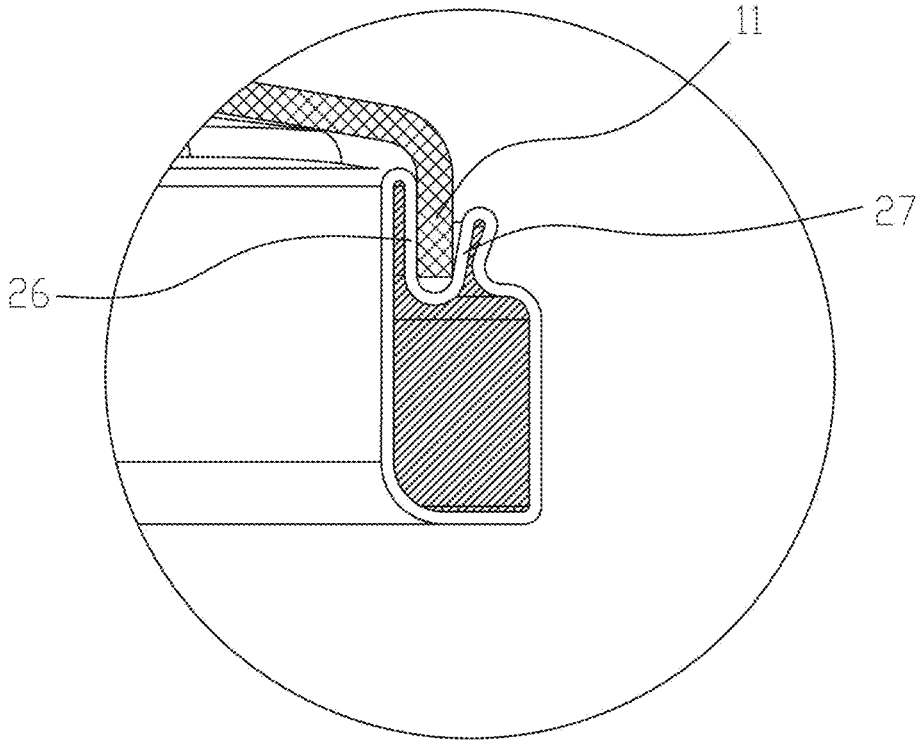
FIG. 6 illustrates a diagrammatic view of the seat board shown in FIG. 2, when a folded-downward edge is disposed in an installation groove and the folded-downward edge is not fixed.
Figure 7:
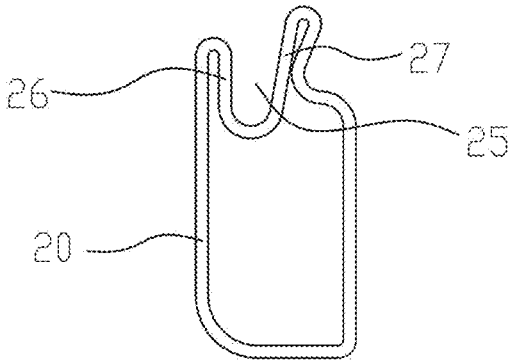
FIG. 7 illustrates a diagrammatic view of a first structural alternative of the bottom frame of the seat board shown in FIG. 2.
Figure 8:
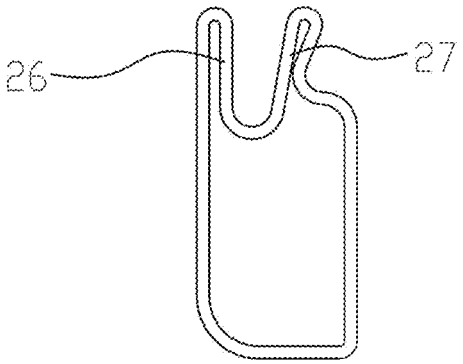
FIG. 8 illustrates a diagrammatic view of a second structural alternative of the bottom frame of the seat board shown in FIG. 2.

The annular inner blocking edge 26 and the annular outer pressing edge 27 are configured to fixedly clamp and secure the annular folded-downward edge 11. The annular inner blocking edge 26 can be higher than the annular outer pressing edge 27 (as shown in FIGS. 5 and 9), the annular inner blocking edge 26 can be lower than the annular outer pressing edge 27 (as shown in FIGS. 7 and 10), or the annular inner blocking edge 26 and the annular outer pressing edge 27 can have equal heights (as shown in FIGS. 8 and 11).

The aforementioned description is only preferred embodiments of the present disclosure, and the scope of the present disclosure cannot be therefore limited. That is, equivalent variations and modifications should still fall within the scope of the present disclosure provided that they are made based on the scope of the present disclosure and the content of the specification.

What is claimed is:

1. A seat board of a foldable chair, comprising:

a panel, and a bottom frame, wherein:

the bottom frame is formed by bending a metal material sheet, has a rectangular shape, and has smooth transitions on four corners, a top portion of the bottom frame is bent to form an annular inner blocking edge and an annular outer pressing edge, an annular installation groove having an upper opening is formed between the annular inner blocking edge and the annular outer pressing edge, four sides of the panel form an annular folded-downward edge folded downward, the annular folded-downward edge is inserted into the annular installation groove from top to bottom, the annular inner blocking edge cooperates with the annular outer pressing edge to clamp and secure the annular folded-downward edge, two elongated sliding slots extending in a front and rear direction and configured for two T-shaped rivets to slide are symmetrically located on an outer side edge of a left side of the bottom frame and an outer side edge of a right side of the bottom frame, first ends of the two elongated sliding slots comprise enlarged holes into which caps of the two T-shaped rivets are configured to be inserted from outside, widths of the caps of the two T-shaped rivets are greater than widths of slot openings of the two elongated sliding slots and are smaller than widths of the enlarged holes, and two rivets for pivotally connecting to chair legs of the foldable chair are installed at positions of the enlarged holes after the two T-shaped rivets are inserted into the two elongated sliding slots.

2. The seat board of the foldable chair according to claim 1, wherein:

an inner side edge and an outer side edge of a side portion of the bottom frame are vertical edges.

3. The seat board of the foldable chair according to claim 2, wherein:

bent steps are respectively formed on a top position and a bottom position of an outer side edge of a section of the bottom frame.

4. The seat board of the foldable chair according to claim 1, wherein:

a section of the bottom frame is a closed-ring hollow tube structure.

5. The seat board of the foldable chair according to claim 4, wherein:

bent steps are respectively formed on a top position and a bottom position of an outer side edge of the section of the bottom frame.

6. The seat board of the foldable chair according to claim 4, wherein:

an outer side edge of the section of the bottom frame is a vertical edge, and a bottom edge of the section of the bottom frame is a horizontal straight edge.

7. The seat board of the foldable chair according to claim 6, wherein:

bent steps are respectively formed on a top position and a bottom position of the outer side edge of the section of the bottom frame.

8. The seat board of the foldable chair according to claim 6, wherein:

an inner end of the bottom edge of the section of the bottom frame is bent upward and toward an inner side of the bottom frame to form a C-shaped extension segment.

9. The seat board of the foldable chair according to claim 8, wherein:

bent steps are respectively formed on a top position and a bottom position of the outer side edge of the section of the bottom frame.

10. The seat board of the foldable chair according to claim 6, wherein:

an inner end of the bottom edge of the section of the bottom frame is bent to form an inclined extension segment with a distal end of the inclined extension segment abutting the bottom edge of the section of the bottom frame.

11. The seat board of the foldable chair according to claim 6, wherein:

an inner end of the bottom edge of the section of the bottom frame is bent to form a horizontal extension segment abutting the bottom edge of the section of the bottom frame by stacking.

12. The seat board of the foldable chair according to claim 1, wherein:

bent steps are formed on both a top position and a bottom position of an outer side edge of a section of the bottom frame.

13. A seat board of a foldable chair, comprising:

a panel, and a bottom frame, wherein:

the bottom frame is formed by bending a metal material sheet, has a rectangular shape, and has smooth transitions on four corners, a section of the bottom frame comprises a top portion, side portions, and a bottom portion, the top portion of the bottom frame is bent to form an annular inner blocking edge and an annular outer pressing edge, an annular installation groove having an upper opening is formed between the annular inner blocking edge and the annular outer pressing edge, four sides of the panel form an annular folded-downward edge folded downward, the annular folded-downward edge is inserted into the annular installation groove from top to bottom, the annular inner blocking edge cooperates with the annular outer pressing edge to clamp and secure the annular folded-downward edge, two elongated sliding slots extending in a front and rear direction and configured for two T-shaped rivets to slide are symmetrically located on an outer side edge of a left side of the bottom frame and an outer side edge of a right side of the bottom frame, and the two T-shaped rivets are slidably connected to the seat board and chair legs of the foldable chair.

14. The seat board of the foldable chair according to claim 1, wherein:

a section of the bottom frame is a non-closed ring with a side facing inward being an open structure.

* * * * *